US005410212A

United States Patent [19]

Reisman

[11] Patent Number: 5,410,212

[45] Date of Patent: Apr. 25, 1995

[54] SOFT WHITE REFLECTOR LAMP

[75] Inventor: Juliana P. Reisman, Lyndhurst, Ohio

[73] Assignee: General Electric Company, Schenectady, N.Y.

[21] Appl. No.: 40,721

[22] Filed: Apr. 1, 1993

[51] Int. Cl.[6] ..... H01K 1/32

[52] U.S. Cl. ..... 313/116; 313/113; 313/112

[58] Field of Search ..... 313/113, 112, 25, 478, 313/116; 359/599, 535; 385/31; 428/324; 427/106

[56] References Cited

U.S. PATENT DOCUMENTS

| | | | |
|---|---|---|---|
| 2,706,262 | 4/1955 | Barnes | 313/478 |
| 2,733,166 | 1/1956 | Shoenfeldt et al. | 117/35 |
| 3,909,649 | 9/1975 | Arsena | 313/116 |
| 4,039,878 | 8/1977 | Eijkelenboom et al. | 313/113 |
| 4,041,344 | 8/1977 | LaGiusa | 313/113 |
| 4,209,430 | 6/1980 | Weber | 260/23 |
| 4,340,273 | 7/1982 | Jack et al. | 359/535 |
| 4,416,940 | 11/1983 | Loye et al. | 428/324 |
| 4,648,690 | 3/1987 | Ohe | 359/599 |
| 4,985,275 | 1/1991 | Takemura et al. | 427/106 |
| 4,989,933 | 2/1991 | Duguay | 385/31 |
| 4,999,055 | 3/1991 | Holtzen et al. | 106/436 |
| 5,032,425 | 7/1991 | Livsey et al. | 427/57 |
| 5,093,601 | 3/1992 | Watanabe et al. | 313/25 |
| 5,177,395 | 1/1993 | Reisman | 313/112 |

*Primary Examiner*—Donald J. Yusko
*Assistant Examiner*—Donald J. Richardson
*Attorney, Agent, or Firm*—Stanley C. Corwin; Edward M. Corcoran

[57] ABSTRACT

Incandescent reflector lamps of the R and ER type having a metallic light-reflecting coating inside exhibit a pleasing soft white appearance with substantially diminished glare and filament hot spots when the forward, light-projecting portion of the lamp envelope is coated with a coating comprising a silicone containing untreated titanium dioxide particles of a relatively coarse or large size.

21 Claims, 1 Drawing Sheet

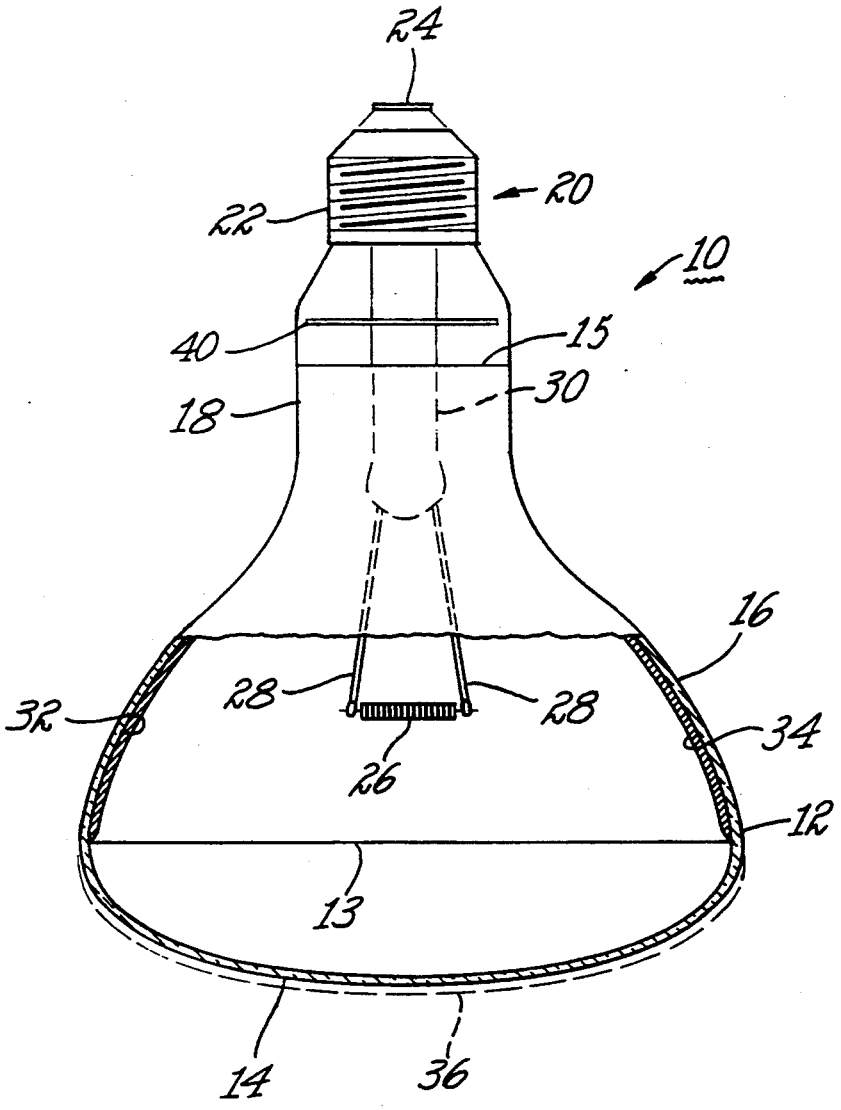
24
20
22
10
40
15
30
18
16
28
28
32
34
26
12
13
14
36

SOFT WHITE REFLECTOR LAMP

BACKGROUND OF THE INVENTION

1. Field of the Invention

This invention relates to a soft white reflector lamp. More particularly, this invention relates to a reflector lamp comprising a filament as the light source enclosed within a glass envelope having a parabolic reflecting portion and with the forward, light-transmitting portion coated with a silicone coating containing coarse particles of titanium dioxide for dispersing the filament image and producing an aesthetically and visually pleasing soft white effect.

2. Background of the Disclosure

Electric lamps employing a filament or arc as the source of light emit light in a pattern in which the light source is visible, unless the emitted light is broken up. Further, unless there is a light-diffusing means between the source of light and the object or area to be illuminated, the light source can also produce unpleasant glare and bright spots in the beam and the lamp itself is unpleasant to look at due to the glare from the surface of the lamp and the concentrated light intensity coming from the light source. Means commonly employed to break up a light source image include a lenticuled lens (in the case of certain types of reflector lamps), sandblasting the lamp envelope, acid etching the lamp envelope or coating the lamp envelope with a powder coating on the interior surface to scatter the emitted light and diffuse the light source image. Acid etching or coating the interior surface of a lamp envelope is most commonly found in a conventional household type of incandescent lamp wherein the glass envelope enclosing the filament is acid etched (frosted) and/or coated with a particulate, light-diffusing material. A mixture of clay and silica is often used as the particulate, light-scattering material, because of its availability, light-scattering properties, chemical inertness and ability to withstand the high temperatures reached during lamp operation. However, with the exception of acid etching, none of these methods are suitable for use with the type of reflector lamps commonly known as R or ER lamps, wherein the lamp comprises a unitary, blown glass envelope enclosing a filament within and having an internal reflecting surface on which is disposed light-reflecting material for reflecting a portion of the light emitted by the filament forward of the lamp through the clear or acid etched, light-transmissive forward portion. These R and ER lamps are used as decorative lamps and also to provide light illumination in a particular direction and have found wide application both commercially and in household use. These lamps have a typical metal screw base at one end similar to that of a conventional incandescent lamp and are generally employed with or without a lighting fixture with the metal base portion up so that the light emitted by the filament is projected generally downward. There is a needle for a lamp of this type which projects a white light, exhibits less glare and wherein the filament image is at least partially diffused.

SUMMARY OF THE INVENTION

The present invention relates to a lamp comprising a vitreous envelope enclosing an electric source of light within wherein at least a portion of the envelope is coated with a silicone coating containing light-scattering particles and preferably relatively coarse particles of titanium dioxide for dispersing the filament image and producing an aesthetically and visually pleasing soft white effect which is useful as both a decorative lamp and for general illumination purposes. It is also preferred that the particulate titanium dioxide be untreated which means that it has not been treated with or coated with an organic compound as is common practice with finer size, pigment grade titanium dioxide. In one embodiment the lamp will be a reflector lamp enclosing a source of electric light such as an arc or filament and having a light-reflective surface for reflecting the light produced by the light source forward of the reflector through a vitreous light-transmitting portion, with the vitreous light-transmitting portion containing a silicone coating containing coarse particles of untreated titanium dioxide according to the invention. The invention is particularly useful with an R and ER type of reflector lamp which comprises a blown glass lamp envelope hermetically enclosing a filament within wherein said envelope has a reflecting portion comprising a light-reflecting coating on a portion of the interior surface of the lamp envelope and wherein the forward, light-transmissive portion of the glass envelope is coated with a silicone coating containing coarse particles of titanium according to the invention. Lamps of this type have been made according to the invention wherein the lumen loss was less than 5% and in many cases less than 2% compared to the same lamp without the titanium dioxide containing silicone coating on the forward light-transmissive portion of the lamp.

BRIEF DESCRIPTION OF THE DRAWING

The FIGURE schematically illustrates a typical R type of incandescent lamp wherein the outside surface of the forward, light-transmissive portion is coated with a soft white coating according to the invention.

DETAILED DESCRIPTION

Turning to the Figure, an R type of lamp 10 is schematically illustrated in a base-up position and comprises a blown glass envelope 12 having a forward, light-transmissive portion 14, a reflecting portion 16 and a stem portion 18 with a conventional metal screw base 20 having threads 22 and an eyelet or contact 24. Inside the lamp envelope filament 26 is supported by a pair of filament support wires 28 mounted in a reentrant glass stem portion 30. The inner surface 32 of reflecting portion 16 is coated with a coating 34 which is silver, gold, aluminum or other reflective metallic material as is known to those skilled in the art and which extends to bowl-shaped forward portion 14 as indicated at 13 and also into neck portion 18 as indicated at 15. In one embodiment of a reduction to practice of the invention, light-reflective coating 34 was silver. Silver is preferred to aluminum, because the aluminum is applied in the form of flakes in a coating vehicle and results in a significant loss of light output of the lamp. Forward, light-transmitting portion 14 is coated on the outside with a coating 36 according to the invention comprising a silicone resin in which is dispersed light-scattering particulate material, preferably a large particle size titanium dioxide. As is known to those skilled in the art, neck portion 18 is elongated to isolate the seal area and base portion of the lamp from the filament and reduce thermal stress in the seal area and to the base. An aluminum heat shield 40 in the form of a disk which is pressed onto stem 30 to further reduce the heat transmitted to the base. Also, as illustrated in the Figure, the lamp is depicted with its base up and the forward, light-transmitting bowl portion 14 of lamp envelope 12 in a downward position. This insures that the light is projected downwardly of the lamp and is also important in insuring that the temperature of the surface of the glass of bowl-shaped forward, light-transmitting portion 14 does not get so hot as to result in the coating 36 peeling, cracking or flaking off during operation of the lamp. Light reflecting portion 14 may be parabolic, spherical or ellipsoidal in shape or have a compound shape combining one or more of these individual shapes. In most instances reflecting portion 14 will have a parabolic (R lamp) or ellipsoidal (ER lamp) light-reflecting shape. During operation of the lamp a significant amount of the visible light emitted by filament 26 strikes the metallic light-reflecting coating 34 and is projected forward through light-transmissive portion 14 in the desired beam pattern which is determined in large measure by the shape of the reflecting portion 14. Also, a significant amount of visible light radiation emitted by filament 26 is also projected out of the lamp and through light-transmissive portion 14 without striking the metallic, light-reflecting surface 34.

Without the soft white coating 36 of the invention applied to the surface of the light-transmissive portion 14 of the lamp, the lamp exhibits a hot spot in the beam pattern due to the projected filament image in the beam pattern and also exhibits a significant amount of glare which makes it unpleasant to look at. Thus the emitted light can be harsh and glary with a filament image and the lit lamp itself is extremely bright and unpleasant to look at even if the interior surface of 14 is acid etched. With the coating 36 of the invention present on the light-transmitting portion 14 of the lamp envelope, the filament image is broken up and diffused in the emitted light as a soft white light which is pleasing to the eye and the lamp itself does not exhibit the harsh glare and hot spots which lamps of this type normally have without the coating of the invention, irrespective of whether or not the light-transmitting portion 14 is clear or acid etched.

As set forth above, the coating of the invention is a silicone material containing particulate, light-scattering particles of titanium dioxide. It has been found and forms a part of the present invention, that the particulate titanium dioxide light-scattering particles are not the very fine particle size titanium dioxide typical of a pigment grade of titanium dioxide normally used for various types of coatings. Moreover, it has also been found that the titanium dioxide particles should be untreated which, in itself, is contrary to normal coating technology and practice. That is, a pigment grade of particulate titanium dioxide used for coating applications, besides being of a very fine particle size, is invariably treated or coated with an organic material to enable wetting of the particles by the resin or other organic vehicle in which the titanium dioxide is dispersed. Thus, by untreated titanium dioxide is meant titanium dioxide that has not been treated with an organic compound, but is not meant to exclude titanium dioxide particles that have been treated with an inorganic compound (such as silica or alumina). One particulate titanium dioxide material that has been found to be useful in the practice of the invention is a Kronos R 3020 titanium dioxide which is a free flowing, coarse particle size, high purity grade of titanium dioxide which is not surface treated. This type of titanium dioxide is a non-pigment type which is normally used as an ingredient in glass in various glass manufacturing processes and is principally rutile titanium dioxide. This titanium dioxide is 99.5% pure with very minor amounts of iron, chromium and vanadium and has a typical particle size of 35% being retained on a 35 mesh screen and from 75–85 wt. % retained on a 325 mesh screen. Thus, this titanium dioxide useful in the practice of the invention has a particle size distribution such that over 50% is retained on a 325 mesh screen. This is in marked contrast to pigment grade titanium dioxide having a smaller particle size of which little if any (i.e., less than 1%) is retained on a 325 mesh screen. The particle size distribution of the Kronos 3020 titanium dioxide is about 10% having a size of 0.38 microns; 50% of 0.86 microns and 90% of 2.03 microns, with an overall mean particle size having a value of 1.03 microns. When pigment grades of titanium dioxide were used in trying to achieve a soft white coating according to the invention, the coating was too opaque with a substantial loss in lumen output of the lamp. As set forth above, in the practice of the invention, the total lumen output of the soft white coated lamp was reduced by less than 2% and less than 5% depending on the coating thickness which generally ranged between 1 to 5 mils compared to an uncoated lamp as measured in an integrating sphere. This lumen loss is well within acceptable limits for achieving the benefits of the coating of the invention.

The silicone resin which is used in the coating is a heat-resistant type available from many suppliers such as GE, Dow Chemical and others and is generally formed from a silane having methyl and/or phenol functionally and preferably at least methyl functionality which forms an essentially silane free silicone on curing. Thus, the silicone is formed from di and trifunctional methyl and/or phenol substituted silanes. Examples of commercially available silicone resins which will work in the practice of the invention also include silicone polyester resins available from a number of manufacturers including the Silicone Products Division of General Electric Company in Waterford, N.Y., and the Dexter Corporation in Waukegan, Ill. As set forth above, the titanium dioxide should be an untreated form of relatively large particle size titanium dioxide. It has been found that small particle size pigment grade of titanium dioxide normally used for coatings results in too much opacity with a large lumen loss (i.e., 30% to 50% loss) of light output from the lamp and concomitant overheating and cracking of the coating from the glass surface of the lamp. An organic surface treatment resulted in lumping and gelling of the silicone, reducing shelf life to a week (instead of six months) and almost solidifying the coating prior to applying it to the lamp. As set forth above, the Kronos 3020 has been found to work satisfactorily in the process of the invention and this is an untreated form of rutile titanium dioxide.

A soft white coating according to the invention was made by ball milling an SK9A silicone polyester resin obtained from the Dexter Corporation with the Kronos 3030 titanium dioxide. The silicone resin was 50% solids and the wt. % of silicone resin (including solvent in the as-received condition) and titanium dioxide were 88 wt. % and 12 wt. % of resin and pigment, respectively. This was ball milled for 30 hours with silica milling stones and to this titanium dioxide and silicone dispersion was added additional silicone resin and also n-propyl acetate which was again ball milled but only for an hour to lower the viscosity. The final coating composition was as follows, with the silicone and titanium dioxide being on a solids basis:

| Silicone Polyester Resin | Titanium Dioxide | n-propyl acetate |
|---|---|---|
| 85.7 wt. % | 4.57 wt. % | 9.68 wt. % |

This coating was sprayed on the clear, light-transmissive end of the lamp of the type illustrated in the Figure and described above to get a dry coating thickness of about 1 to 5 mils, with 3 mils being optimum. The air dried coating was cured in an oven for 10 minutes at 250° C. or 22 minutes at 220° C. Lamps were tested in the base up position and found to last for over 2000 hours without any splitting, cracking, flaking or discoloration of the coating. The loss in lumen output was less than 5% for the coated lamps and generally no more than 2% and the lamps had an aesthetically pleasing appearance. The emitted light was a very pleasing soft white. This thus represents a significant improvement in the art for this type of lamp. The lamps that were tested were both 75 watts and 50 watts and the surface temperature of the light-transmissive portion of the blown glass lamp envelope to which the coating was applied was found to be about 130° C. during operation of the lamp. It is understood that various other embodiments and modifications of the practice of the invention will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A lamp comprising a vitreous envelope enclosing an electric light source wherein at least a portion of said envelope is coated with a coating comprising a silicone material containing coarse light-scattering particles, said coating being effective to substantially eliminate filament hot spots and glare when said lamp is energized said particles having a particle size distribution whereby over 50 weight percent is retained on 325 mesh screen.

2. A lamp of claim 1 wherein said coarse light-scattering particles comprise titanium dioxide.

3. A lamp of claim 2 wherein said titanium dioxide particles are untreated.

4. A lamp of claim 3 wherein said titanium dioxide is rutile titanium dioxide.

5. A lamp according to claim 2, wherein said titanium dioxide is greater than 99.5% pure.

6. A lamp according to claim 1, wherein said coating being effective to reduce the lumen output by less than 30% when said lamp is energized.

7. A lamp according to claim 1, wherein said coating being effective to reduce the lumen output by less than 5% when said lamp is energized.

8. A lamp according to claim 1, wherein said coating being effective to reduce the lumen output by less than about 2% when said lamp is energized.

9. A lamp of claim 1 wherein said silicone material comprises a silicone polyester.

10. A reflector lamp comprising a glass envelope enclosing a filament within capable of providing a lumen output, said envelope including a light-reflecting portion and a forward, light-transmitting portion, with said light-transmitting portion being coated with a coating comprising a silicone material containing coarse light-scattering particles of titanium dioxide, said coating being effective to substantially eliminate filament hot spots and glare when said lamp is energized, said particles having a particle size distribution whereby over 50 weight percent is retained on 325 mesh screen.

11. A lamp according to claim 10 wherein said titanium dioxide particles are untreated.

12. A lamp according to claim 11 wherein said titanium dioxide particles are rutile.

13. A lamp according to claim 10, wherein said coating being effective to reduce the lumen output by less than 30% when said lamp is energized.

14. A lamp according to claim 10, wherein said coating being effective to reduce the lumen output by less than 5% when said lamp is energized.

15. A lamp according to claim 10, wherein said coating being effective to reduce the lumen output by less than about 2% when said lamp is energized.

16. A lamp of claim 10 wherein said silicone material comprises a silicone polyester.

17. A lamp according to claim 10 wherein said coating gives said lamp a soft white appearance when energized, said soft white appearance being substantially free of filament hot spots and glare when energized.

18. A lamp according to claim 16 wherein said coating gives said lamp a soft white appearance when energized, said soft white appearance being substantially free of filament hot spots and glare when energized.

19. A reflector lamp comprising a unitary glass envelope enclosing a filament as a source of light within capable of providing a lumen output when energized, with said envelope having a light-reflecting portion and a forward, light-transmitting portion and wherein said light-reflecting portion is coated on its interior surface with a metallic, light-reflecting coating and wherein said light-transmitting portion is coated with a coating comprising a silicone material containing light-scattering particles of untreated titanium dioxide which gives said lamp a soft white appearance when energized, said coating being effective to substantially eliminate filament hot spots and glare when said lamp is energized, said particles having a particle size distribution whereby over 50 weight percent is retained on 325 mesh screen.

20. A lamp according to claim 19 wherein said titanium dioxide is rutile.

21. A lamp according to claim 20 wherein said titanium dioxide particles have a particle size distribution such that over 50% is retained on a 325 mesh screen.

* * * * *